United States Patent [19]

Barp et al.

[11] 4,100,683

[45] Jul. 18, 1978

[54] DRYING CYLINDER FOR A PAPER MAKING MACHINE

[75] Inventors: Bruno Barp, Rudolfstetten, Switzerland; Herbert Holik, Ravensburg, Germany

[73] Assignee: Escher Wyss GmbH, Ravensburg, Germany

[21] Appl. No.: 683,379

[22] Filed: May 5, 1976

[30] Foreign Application Priority Data

May 12, 1975 [CH] Switzerland ..... 6030/75

[51] Int. Cl.[2] ..... F26B 11/02

[52] U.S. Cl. ..... 34/124; 34/119; 34/125; 165/89

[58] Field of Search ..... 34/119, 124, 125; 165/89, 90, 179, 181

[56] References Cited

U.S. PATENT DOCUMENTS

| | | | |
|---|---|---|---|
| 1,453,113 | 4/1923 | Hutchins | 34/125 |
| 3,367,042 | 2/1968 | Cox, Jr. | 34/124 |
| 3,659,349 | 5/1972 | Nykopp | 34/124 |

*Primary Examiner*—Kenneth W. Sprague
*Assistant Examiner*—James C. Yeung
*Attorney, Agent, or Firm*—Kenyon & Kenyon, Reilly, Carr & Chapin

[57] ABSTRACT

The internal ribs of the drying cylinders are formed with cross-sections which are of parabolic shape or substantially parabolic shape in order to obviate any additional thermal stressing of the cylinder. The rib cross-sections are each situated in a zone bounded outwardly by a hexagon which consists of a rectangle of full rib width and a height equal to 0.75 times the rib height and an adjoining trapezium having a width 0.65 times the maximum rib width at the top of the rib and inwardly by a pentagon of a width of 0.7 times the full width at mid-height of the rib and an apex at the maximum height of the rib.

10 Claims, 10 Drawing Figures d
d
5'
c
b
a

B'
S
i
h
P2
P1
g
H
F
j
M
k
B''
A
B
k
M
j
h
g
F
H''
H'

20
t
T
F
R
22
21

DRYING CYLINDER FOR A PAPER MAKING MACHINE

This invention relates to a drying cylinder for a paper making machine.

As is known, paper making machines employ drying cylinders which are heated by condensing steam in order to dry paper. In many instances, a drying cylinder is made of a cylindrical barrel with annular ribs on the inside periphery of the barrel and with tubes which extend into intermediate spaces between the ribs in order to remove water of condensation. Drying cylinders of this kind are described, for example, in German Patent specification No. 497,034, U.S. Pat. No. 2,521,371 and U.S. Pat. No. 3,241,251.

As described in German Patent specification No. 497,034, the heat transfer from a steam chamber of a drying cylinder to the cylinder surface can be improved by the provision of ribs on the inside of the cylinder. In this case, the ribs emerge from the layer of condensate during operation. Hence, the steam on the ribs can be brought into direct contact with the metal of the cylinder barrel.

While U.S. Pat. No. 2,521,371 discloses ribs of triangular cross-section, U.S. Pat. No. 3,241,251 recommends rectangular ribs as far as possible, because the moment of inertia of the rib is said to be at a maximum.

During operation of a drying cylinder of this type, there is in fact a complicated loading of the cylinder due to internal pressure, centrifugal forces, thermal stresses and linear forces applied by contact-pressure cylinders. It has now been found that the thermal stresses caused by the ribs may result in a considerable additional loading on the cylinder wall, particularly in the case of cylinders subjected to heavy loading, i.e. those having internal pressures of from 8 to 10 atmospheres gauge and more, and high circumferential speeds. As a result, the inner ends of the ribs entering the cylinder steam chamber have a much higher temperature than the cylinder wall, particularly the outer surface, at which the heat is dissipated by the paper to be dried. These hotter ribs expand more than the cylinder wall and subject the wall cross-section to a loading by tensile forces on which are superimposed the tensile forces due to the internal pressure and the loading by centrifugal force.

This disadvantage is less pronounced in the case of ribs having a triangular cross-section according to U.S. Pat. No. 2,521,371, because the hottest zones of the ribs, i.e. their inner ends, have a small cross-section, so that they cannot subject the barrel to loading. However, there is a number of other disadvantages with these ribs, for example the absence of adequate intermediate spaces between the ribs to take up the condensate, relatively poor utilization of the heat transfer surface — as will be explained hereinafter — and finally the formation of high stress peaks in the inner ends of the ribs when the barrel is subjected to bending stress by contact-pressure rolls.

Accordingly, it is an object of the invention to provide a drying cylinder of the above kind in which the disadvantages of the known cylinders are obviated or greatly reduced.

It is another object of the invention to provide an improved rib construction for drying cylinders of paper making machines.

It is another object of the invention to avoid imposing unnecessary thermal stresses on a drying cylinder barrel via internal ribs on the barrel.

Briefly, the invention provides a drying cylinder comprising a cylindrical barrel, a plurality of annular ribs disposed peripherally within and on the barrel in spaced relation to define recesses therebetween and a plurality of tubes for removing condensate within the barrel, each of which extends into a respective recess. Each rib has an axis perpendicular to the longitudinal axis of the barrel and a profile situated in a zone bounded outwardly by a hexagon symmetrical about the rib axis and inwardly by a pentagon symmetrical about the axis. The hexagon consists of a rectangle of a width equal to a rib width and a height equal to 0.75 times a rib height and an adjoining trapezium having a width of 0.65 times the rib width at the maximum rib height. The pentagon has a width of 0.7 times the rib width at the mid-height of the rib and a vertex at the maximum rib height.

It has been found that where heat accumulates in the region of the ribs and is dissipated at the barrel surface, as is the case in practice, the temperature pattern in the ribs is one in which the isotherms approximately have the form of parabolae. This means that the rib profile material situated outside the parabola inscribed in a rectangular rib is not utilized for the heat transfer but that the thermal expansion of the rib subjects the cylinder barrel to loading. According to the invention, this is obviated by removing at least the majority of material not participating in the heat transfer from the top zone of the rib. The rib profile need not have exactly the shape of the isotherms but may be modified in various ways for reasons associated with manufacture.

For example, the cross-sectional shape of the rib may be bounded by straight lines whereby the ribs themselves are simple to manufacture as are the tools for their production.

The top area of the rib may also be bounded by at least one arc of a circle whereby the advantages of a relatively large surface are combined with the advantage of a cross-sectional shape in which the condensate forming on the inner top end of the rib can flow off satisfactorily into the grooves between the ribs.

The cross-sectional shape of the rib may of course be a parabola having the formula $y = x^n$ where $n = 2$ to 8.

In a rib preferred for manufacturing reasons, the rib cross-section may be bounded up to half its height by a quadrilateral having sides substantially perpendicular to the cylinder axis and followed by a trapezium wherein the width of the side forming the top boundary of the rib cross-section is equal to substantially half the maximum rib width.

In one further advantageous embodiment, the rib cross-section may be bounded by lines substantially perpendicular to the cylinder axis followed by at least one arc of a circle which forms the top end of the cross-section and which connects the two sides of the rib cross-section. In either case, ribs are obtained in which the desired effect can be achieved with sufficient accuracy and simple means in terms of manufacture.

These and other objects and advantages of the invention will become more apparent from the following detailed description and appended claims taken in conjunction with the accompanying drawings in which:

Figure 1:
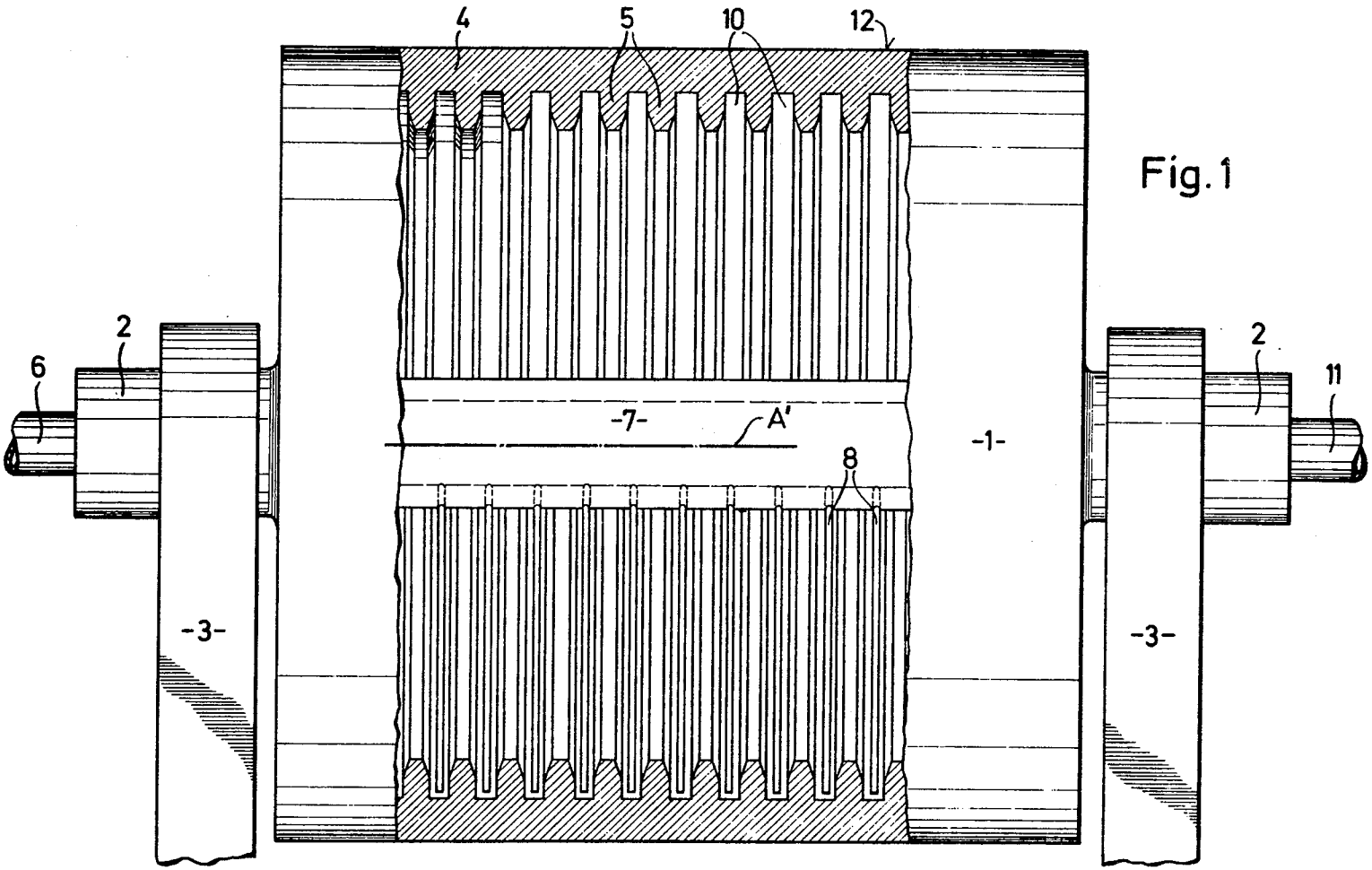
FIG. 1 illustrates a diagrammatic sectional view of a cylinder according to the invention.

Referring to FIG. 1, a drying cylinder 1 is rotatably mounted via journals 2 in a stand and includes a barrel 4 provided with internal peripherally disposed spaced apart annular ribs 5 for purposes of heat transfer as is known. A conduit 6 communicates with the interior of the cylinder 1 to feed steam into the barrel 4. A tube 7 is provided in the cylinder 1 and connects with a plurality of tubes 8 which lead into intermediate spaces 10 between the ribs 5 to remove the water of condensate. The condensate is removed from the tubes 7, 8 via a conduit 11 by means of the pressure in the cylinder in known manner.

Figure 2:
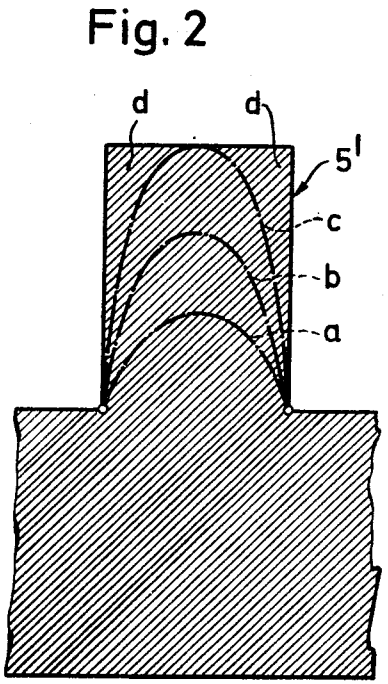
FIG. 2 illustrates a sectional view of a known rib of rectangular profile with isotherms inscribed therein.

Referring to FIG. 2, a rib 5′ of conventional rectangular cross-section is shown with isotherms *a, b* and *c* of different temperatures, *c* being equivalent to the maximum temperature in the rib. This temperature is substantially the same as the temperature in the corner zones *d* of the rib 5′ outside the isotherm *c*. The material in these corner zones is valueless as far as heat transfer is concerned, but since the material is hotter than the outer surface 12 of the roll barrel 4 the thermal expansion of the material subjects the outer zone of the roll barrel to loading due to tensile stresses which, during operation, have tensile stresses formed by centrifugal force and internal pressure superimposed thereon.

According to the invention, the material in the corner zones *d* is to be removed at least approximately. A cross-sectional rib shape equivalent to an approximation to a parabola is in most cases sufficient for the purpose according to the invention.

Figure 3:
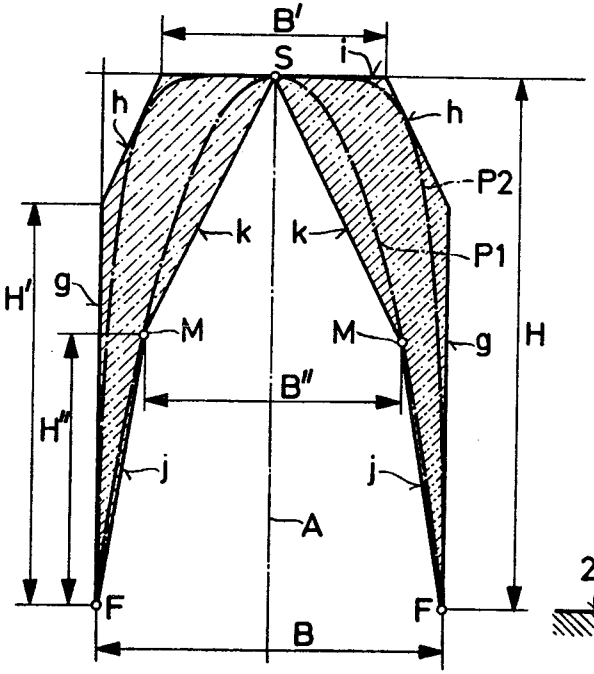
FIG. 3 illustrates a diagrammatic sectional view corresponding to FIG. 2 of a rib illustrating the boundaries of the rib according to the invention.

Referring to FIG. 3, an enlarged-scale view of the cross-section of a rib of originally rectangular cross-section is shown. Two parabolae have been inscribed in the rib profile, the parabola P1 having the formula $y = x^2$ while parabola P2 has the formula $y = x^8$, for in practice, depending upon conditions, the isotherm passing through a vertex S of the rib profile may have a form between these limit values.

In practice, the object of the invention can be achieved with a rib form within the area shown by cross-hatching in FIG. 3. This area is bounded externally by two lines *g* which are parallel to the rib axis A and which have a length H′ = 0.75 times the height (H) of the rib as measured from the foot F of the rib and by two lines *h* formed as tangents to the parabola P2. At the top, the rib profile is bounded by a horizontal line *i*, whose length B′ equals 0.65 times the rib profile width B between the rib foot points F. These sides and the base side form a hexagon. Inwardly, the area is bounded by chords *j* and *k*. The chords *j* lead from the foot points F to points M situated at a height H″ equal to one half the rib height (H/2) and at a distance B′ from one another equal to 0.7 times the width of the rib. The chords *k* lead from the points M to the vertex S. These chords *j, k* and the base side form a pentagon.

Figure 4:
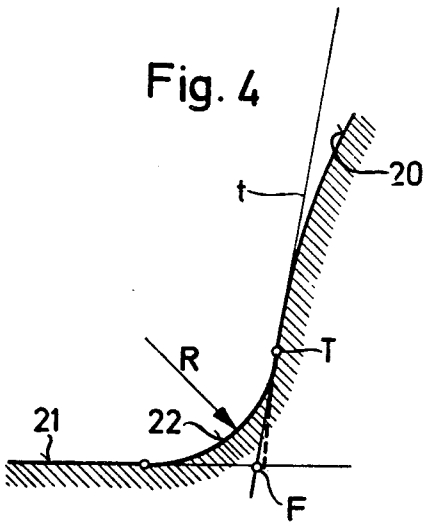
FIG. 4 illustrates a diagram to explain the manner in which the foot points of the rib profile are determined.

FIG. 4 illustrates the manner in which the foot points F are determined in the case of rib profiles wherein there is a curvature 22 of radius R between a curved side surface 20 of the rib 5 and the base 21 of the groove 10. In the present case, all that is required is to draw a tangent *t* to the transition point T of the lines 20 and 22, the foot point F being determined by its point of intersection with a line passing through the base 21 in parallel relationship to the roll axis A′.

Figure 5:
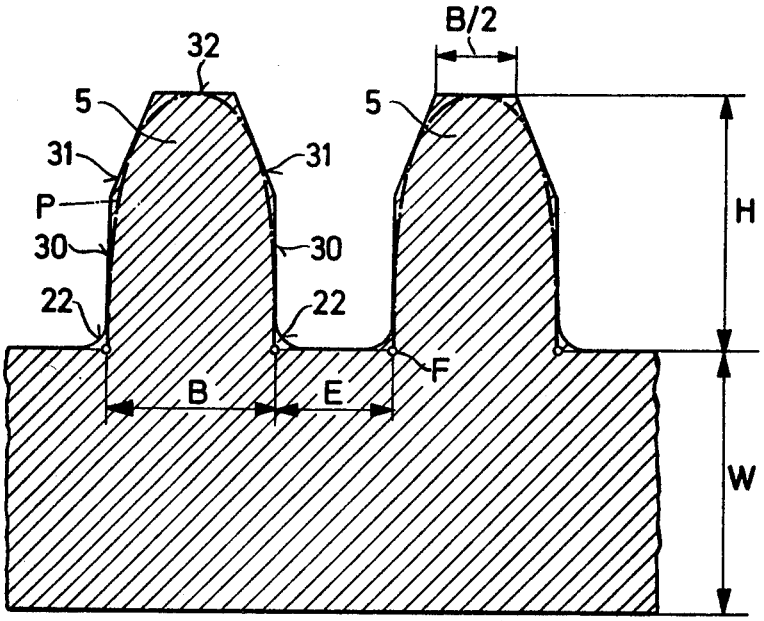
FIG. 5 illustrates a sectional view of a drying cylinder according to the invention.

Referring to FIG. 5, wherein a detail of the roll barrel 4 with two ribs 5 is shown, the rib cross-sections are bounded as far as the zone of half the rib height H by two parallel sides 30 perpendicular to the cylinder axis A′. These sides 30 are followed by sloping sides 31 which extend in such a manner that the apex side 32 forming a top boundary and parallel to the axis A′ has a length (B/2) equal to one-half the rib width.

As shown, the wall thickness W of the actual cylinder barrel and the distance E between the ribs, i.e., the width of the groove 10 are formed to obtain uniform heat distribution at the surface 12 of the roll barrel. To this end, the distance E is usually made smaller than the wall thickness W. In special cases, however, the distance E may also be larger.

With regard to the ratio of the rib height H to the wall thickness W, rib heights H will usually be used which are less than the wall thickness W. The ratio H/W will usually be 0.5 to 1, but of course larger rib heights are possible.

FIGS. 6 to 10 show various other embodiments of the rib.

Figure 6:
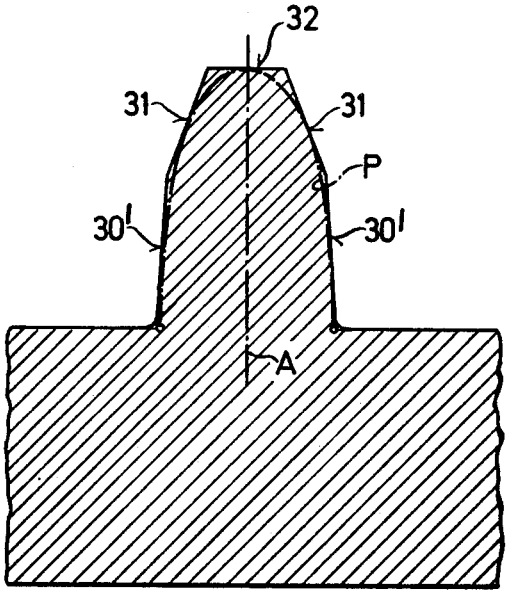
FIGS. 6 to 10 illustrate diagrammatic sections of other embodiments of the ribs according to the invention.

The rib profile shown in FIG. 6 differs from the profile shown in FIG. 5 mainly in that the lateral boundary of the profile is provided by straight lines 30′ which are at an angle to the rib axis A. Manufacturing advantages may be obtained in certain cases by this inclination of the side walls of the ribs.

Figure 7:
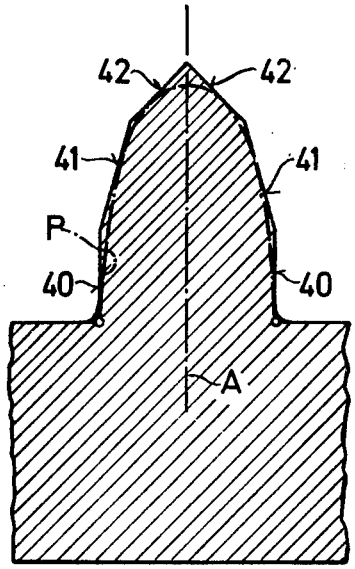

The profile shown in FIG. 7 is bounded on both sides by straight lines 40, 41 and 42. The lines 40 extend in parallel relationship to the rib axis A while the lines 41 and 42 form tangents to an inscribed parabola P similarly to the lines 30′, 31, 32 in FIG. 6.

Figure 8:
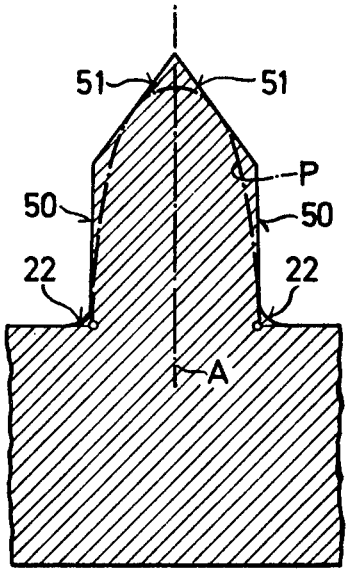
Figure 9:
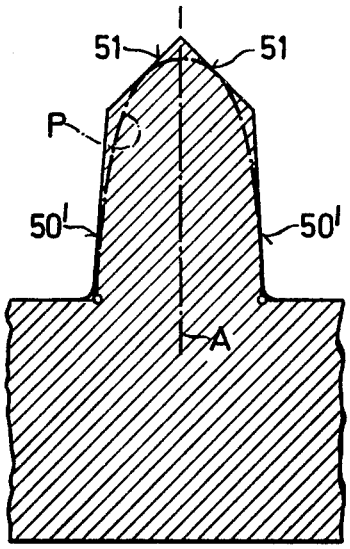

The ribs according to FIGS. 8 and 9 are bounded in each case only by straight lines 50 and 51; 50′, 51′ respectively. The straight lines 50 extend parallel to the axis A while the lines 50′ extend at an angle and form tangents to the inscribed parabola P in the same way as the straight lines 51 in the top zone.

Figure 10:
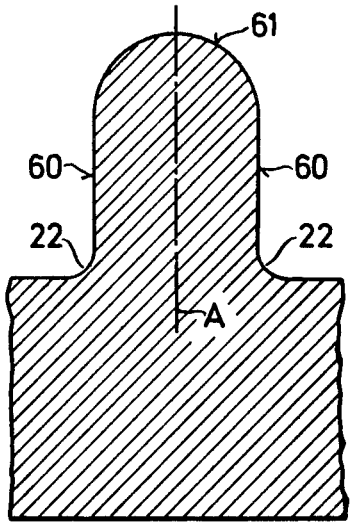

Finally, the profile shown in FIG. 10 is bounded by straight lines 60 which are parallel to the rib axis A and which are interconnected by an arc 61 of a circle. Depending upon the ratio of the rib height to rib width, the arc 61 may be in some cases be replaced by a number of merging arcs of a circle.

What is claimed is:

1. A drying cylinder for a paper-making machine comprising a cylindrical barrel disposed on a longitudinal axis;

a plurality of annular ribs disposed peripherally within and on said barrel in spaced relation to define recesses therebetween, each said rib having an axis perpendicular to said longitudinal axis and a profile situated in a zone bounded outwardly by a hexagon symmetrical about said rib axis and consisting of a rectangle of a width equal to a rib width and a height equal to 0.75 times a rib height and an adjoining trapezium having a width of 0.65 times said rib width at the maximum rib height, and bounded inwardly by a pentagon symmetrical about said rib axis of a width of 0.7 times said rib width at the mid-height of said rib and which has a vertex at said maximum rib height; and a plurality of tubes for removing condensate within said barrel, each tube extending into a respective recess between two adjacent ribs.

2. A drying cylinder as set forth in claim 1 wherein the cross-sectional shape of each rib is bounded by straight lines.

3. A drying cylinder as set forth in claim 2 wherein said rectangle is bounded by sides substantially perpendicular to said longitudinal axis and said trapezium has a width at the maximum rib height of half of the maximum width of the rib.

4. A drying cylinder as set forth in claim 1 wherein the cross-sectional shape of each rib is bounded by at least one arc of a circle.

5. A drying cylinder as set forth in claim 3 wherein each rib has a cross-section bounded by lines which are substantially perpendicular to said longitudinal axis and adjoining which there is at least one arc of a circle which forms the top end of said cross-section and which connects two sides of said rib cross-section.

6. A drying cylinder as set forth in claim 1 wherein the cross-sectional shape of each rib is a parabola of the formula $y = x^n$, where $n = 2$ to 8.

7. A drying cylinder for a paper-making machine comprising a cylindrical barrel disposed on a longitudinal axis for heating under condensed steam;

a plurality of annular ribs disposed peripherally within and on said barrel in spaced relation to define recesses therebetween to receive condensate, each rib being of the same material as said barrel and having a cross-section defined by two parallel sides substantially perpendicular to said axis, an apex side parallel to said axis and two sloping straight sides, each said sloping straight side extending said apex side and one of said parallel sides; and a plurality of tubes for removing condensate within said barrel, each tube extending into a respective recess between two adjacent ribs.

8. A drying cylinder as set forth in claim 7 wherein said parallel sides extend over a height of from 0.5 to 0.75 times the height of a respective rib.

9. A drying cylinder as set forth in claim 8 wherein said apex side is of a length of from 0.5 to 0.65 times the maximum width of a respective rib.

10. A drying cylinder as set forth in claim 7 wherein said apex side is of a length of from 0.5 to 0.65 times the maximum width of a respective rib.

* * * * *

UNITED STATES PATENT AND TRADEMARK OFFICE

CERTIFICATE OF CORRECTION

PATENT NO. : 4,100,683

DATED : July 18, 1978

INVENTOR(S) : Bruno Barp, Herbert Holik

It is certified that error appears in the above-identified patent and that said Letters Patent are hereby corrected as shown below:

In the Abstract line 10 after "full" insert --rib--

Col. 6, line 13 after "extending" insert --between--

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*